US007766346B2

(12) United States Patent
Spanier et al.

(10) Patent No.: US 7,766,346 B2
(45) Date of Patent: Aug. 3, 2010

(54) STABILIZATION DEVICE SUITABLE FOR SKATE TRAINING

(75) Inventors: Robert Spanier, c/o Skafeez Partnership, 296 Richmond Street West, Suite 300, Toronto, Ontario (CA) M5V 1X2; David Hopkins, 1349 Pape Avenue, Toronto, Ontario (CA) M4K 3X3; Thom Antonio, Toronto (CA); Morgan Matthews, Toronto (CA)

(73) Assignees: Robert Spanier, Toronto (CA); David Hopkins, Toronto (CA); Antonio Thom, Toronto (CA)

( * ) Notice: Subject to any disclaimer, the term of this patent is extended or adjusted under 35 U.S.C. 154(b) by 308 days.

(21) Appl. No.: 11/898,407

(22) Filed: Sep. 12, 2007

(65) Prior Publication Data

US 2009/0064541 A1 Mar. 12, 2009

(51) Int. Cl.
*A63C 1/00* (2006.01)

(52) U.S. Cl. ..... 280/11.12; 36/136; 36/62

(58) Field of Classification Search ..... 280/11.36, 280/809, 811, 814, 816, 818, 825; 36/62, 36/132, 136, 144

See application file for complete search history.

(56) References Cited

U.S. PATENT DOCUMENTS

| | | | | | |
|---|---|---|---|---|---|
| 156,094 | A | * | 10/1874 | Lemmon | 36/62 |
| 756,560 | A | * | 4/1904 | Austin | 36/7.7 |
| 1,570,791 | A | * | 1/1926 | Solarz | 36/62 |
| 2,107,617 | A | * | 2/1938 | Oetterer | 36/62 |
| 2,598,218 | A | * | 5/1952 | Brumby | 36/112 |
| 2,764,417 | A | | 9/1956 | Sweet | |
| 3,181,879 | A | * | 5/1965 | Hodges | 280/11.12 |
| 3,415,528 | A | | 12/1968 | Herold | |
| 3,497,211 | A | | 2/1970 | Nagin | |
| 3,934,892 | A | | 1/1976 | Baikie | |
| 3,951,407 | A | * | 4/1976 | Calacurcio | 473/217 |
| 3,965,585 | A | | 6/1976 | Stewart | |
| 3,999,409 | A | * | 12/1976 | Bell | 70/58 |
| 4,073,075 | A | * | 2/1978 | O'Brien | 36/127 |
| 4,114,295 | A | | 9/1978 | Schaefer | |
| 4,198,771 | A | * | 4/1980 | Foster | 36/136 |
| 4,453,727 | A | | 6/1984 | Bourque | |
| 5,179,847 | A | * | 1/1993 | Dorn | 70/18 |
| 5,183,276 | A | * | 2/1993 | Pratt | 280/11.221 |
| 5,641,169 | A | | 6/1997 | Bekessy | |
| 6,203,028 | B1 | | 3/2001 | Kress | |
| 6,523,835 | B1 | | 2/2003 | Lyden | |
| 6,854,200 | B2 | * | 2/2005 | Hipp et al. | 36/96 |
| 2003/0106243 | A1 | * | 6/2003 | Tucker | 36/62 |
| 2003/0192198 | A1 | * | 10/2003 | Wright et al. | 36/7.7 |
| 2007/0130804 | A1 | * | 6/2007 | Levy et al. | 36/136 |
| 2007/0283596 | A1 | * | 12/2007 | Park | 36/62 |

* cited by examiner

*Primary Examiner*—Lesley Morris
*Assistant Examiner*—Brodie Follman
(74) *Attorney, Agent, or Firm*—Ogilvy Renault LLP

(57) ABSTRACT

A stabilizing training device suitable for use on an ice-skate is disclosed. The device provides a foot retaining portion and a stabilizing portion directly under the foot retaining portion. The unit is designed to provide at least partial resiliency to permit limited lateral movement in use. The device is positioned about the foot or footwear by positioning the former into the foot retaining area. A base extends between foot retaining members of the foot retaining area. The base contacts the sole of the foot or footwear and has, extending downwardly and outwardly therefrom, arms which provide for the stabilizing aspect when the device is in use.

17 Claims, 9 Drawing Sheets

10
38
12
26
14

36
34
46
42
54
50
18
30
24
20
22
28
36
16
32
44
40
46
52

STABILIZATION DEVICE SUITABLE FOR SKATE TRAINING

CROSS-REFERENCE TO RELATED APPLICATIONS

This is the first application filed for the present invention.

FIELD OF THE INVENTION

The present invention relates to a stabilization appliance or device and more particularly, the present invention relates to a device which can be worn about the foot or footwear of a user for providing stability during use of the footwear such as a skate, rollerskate, etc.

BACKGROUND OF THE INVENTION

The prior art is replete with training and stability enhancing devices. Many of these devices are very cumbersome or difficult to use. As an example, ice-skate training has previously been taught by making use of a walker type structure. As is known, these structures comprise hollow tubing and are fairly large and therefore require a significant area for a user to train with such a device. Further, these devices are not suitable for children to use particularly when they are not supervised.

In terms of what the prior art has previously set forth, Herold in U.S. Pat. No. 3,415,528, issued Dec. 10, 1968, provides an ice-skate of a first generation for purposes of training. The embodiment depicted provides a flat sole, the underside of which provides for two blade members in spaced apart relation. The sole provides a heel retaining cup and strap and the instep is provided with a strap for support. The device provided by Herold is useful for training a user to ice-skate, however, there is no possibility to modify the device, once the user becomes sufficiently proficient to not require the structure provided.

Other examples of previous devices have been proposed by Suroff, in U.S. Pat. No. 4,407,522. The patentee teaches the use of a removable device, which device provides spaced apart blades adapted to be releasably engageable with an existing blade of a skate. The arrangement is fixed to an existing skate by means of suitable fasteners and the device extends the entire length of the blade of the skate on both sides. In this manner, a triplet of blades is formed once the device is positioned about the blade. Although useful, this arrangement does not provide any substantial degree of lateral stability and, based on the disclosure of the teachings, would not provide at least some lateral flecture, the latter being an important aspect to properly train a user to skate efficiently.

In further developments of the training/stability art, Sweet, in U.S. Pat. No. 2,764,417, issued Sep. 25, 1956, teaches the use of a stabilizing runner for attachment to the blade of an ice-skate. Several embodiments are disclosed, however, the Sweet reference, from the structural relationship relative to the blade in position would appear to be potentially hazardous to the user. Although lateral stability is provided, the arrangement has a number of relatively straight areas which could easily become caught on an irregular surface such as ice.

In view of the limitations from the existing art, there clearly is a need to provide a device which can be deployed with ease and rapidly and further which could be used safely by children.

The present invention satiates these requirements.

SUMMARY OF THE INVENTION

One object of one embodiment of the present invention is to provide an improved device for effecting stability when applied to the foot or footwear of a user, such footwear comprising, for example, an ice-skate, a roller-skate, an in-line skate, etc.

A further object of one embodiment of the present invention is to provide a stabilizing device suitable for use on a skate, comprising: a first support member and a second support member; each member having a foot retaining segment for abutment against the foot of a user and a stabilizing segment extending outwardly and downwardly from the foot retaining segment adapted for contact with a surface on which lateral stability is required; and releasably engageable lock means on each support member configured for releasable locking engagement with a respective support member, the members, when engaged, defining a foot receiving area.

Yet another object of one embodiment of the present invention is to provide a stabilizing device suitable for use on a skate, comprising: a foot retaining portion for retaining the foot of a user having a base and spaced apart sides each side for contact with the sole of a user's foot or footwear and an extending upwardly from each side; and a stabilizing portion for laterally stabilizing the foot of a user when contacting a surface upon which stability is required, the stabilizing portion including an arm extending from each side of the base and outwardly and downwardly relative thereto.

The arrangement has been found to be user friendly and provide the possibility for quick training for users. The device may be composed of at least two body members which can be adjusted relative to one another to accommodate the foot or footwear of a user. It has been found that by providing a downwardly and outwardly extending stabilizing arm on each one of the body members that sufficient stability can be provided to assist in the training of, for example, skating. The stabilizing arms provide a terminal end which is arcuate or otherwise turned upwardly. In one embodiment, the terminal end portions may include a friction reducing means, an example of which is a ball-bearing. Other suitable examples would be apparent to one skilled in the art.

Once the body members are connected, the foot retaining portion may compressively engage the foot or the footwear of the user to provide for adequate grip. This may be augmented by the use of a strap or, alternatively, the body members may include appertures to receive, laces or straps of the footwear.

A second embodiment of the invention provides a plural armed arrangement where the device includes first and second body members in a co-planar relationship for each body member portion. The co-planar members are connected so that a continuous loop is provided on either side of the device.

With respect to suitable materials, any of the useful plastics, metals, composites may be selected to construct the device. All of these materials inherently provide at least some degree of resiliency or flex and are therefore suitable to achieve the goal of the invention.

Having thus generally described the invention, reference will now be made to the accompanying drawings, illustrating preferred embodiments.

Similar numerals used in the drawings denote similar elements.

DETAILED DESCRIPTION OF THE PREFERRED EMBODIMENT

Figures 1, 1A:
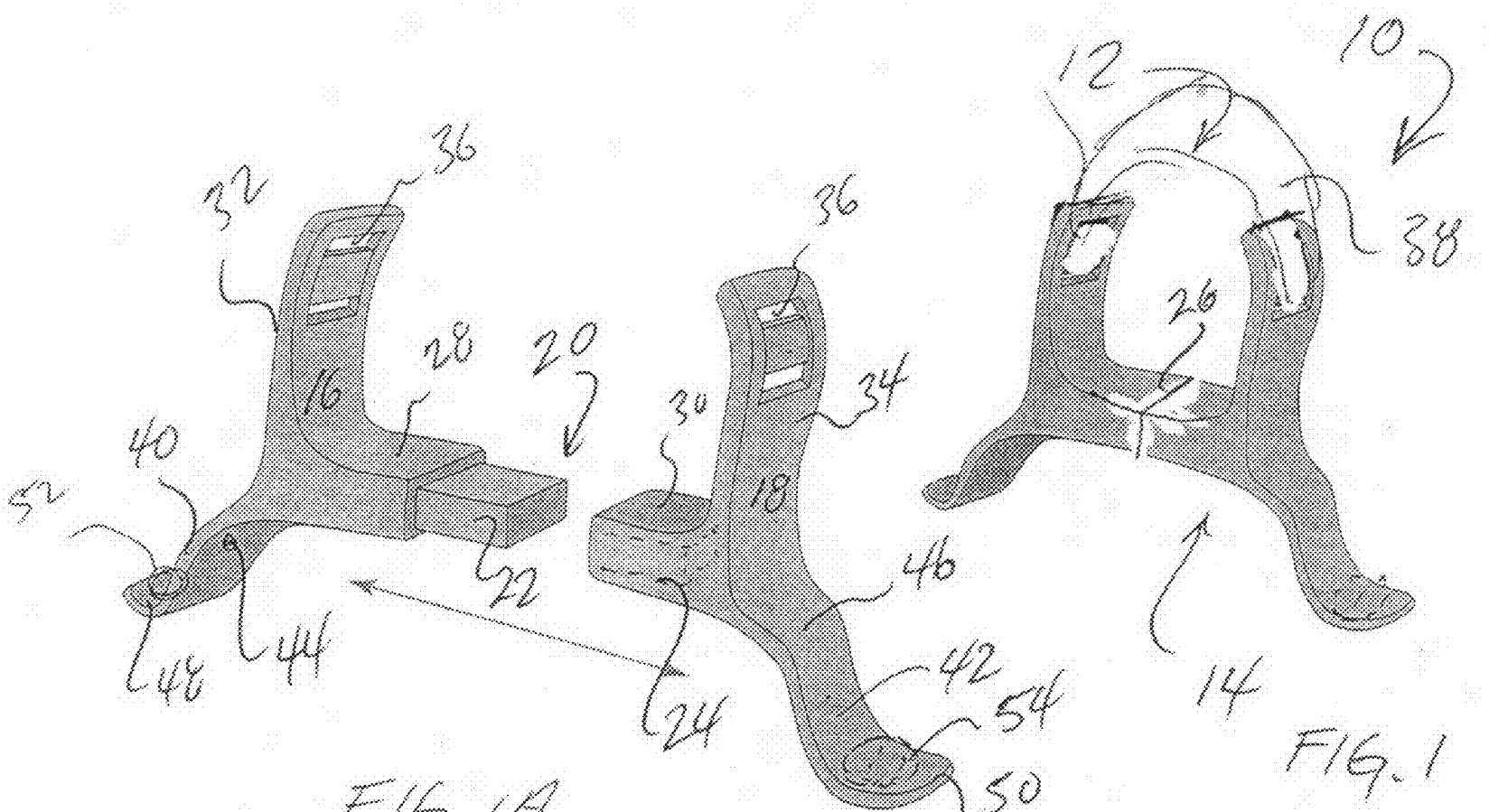
FIG. 1 is a perspective view of one embodiment of the present invention.
FIG. 1A is an exploded view of the device shown in FIG. 1.

Referring now to the drawings and in particular to FIG. 1, shown is a first embodiment of the stabilizing appliance, broadly denoted by numeral 10. In the embodiment shown in FIG. 1, generally speaking, the stabilizing device 10 includes a foot retaining portion, globally denoted by numeral 12, to receive the foot and in particular the sole portion of foot wear of a user and a stabilizing portion, globally denoted by numeral 14, which provides for lateral stabilization of the foot of a user when the appliance is engaged about the foot or the footwear of the user (discussed herein after in greater detail).

Referring now to FIGS. 1 and 1A, the device includes at least two body members 16 and 18, which body members are adapted for releasable engagement. In the embodiment shown in FIG. 1A, releasable lock means, globally denoted by numeral 20, is provided which comprises a compression fit finger 22 and slot 24 shown in dashed line in body number 18. The finger 24 is compressibly retained within the slot to fix, releasably, in a locked engagement the two body members in a position shown in FIG. 1.

In greater detail, in the embodiment shown in FIGS. 1 and 1A, the device 10 provides a base 26 which is formed from base portions 28 and 30 of body member 16 and 18 when the same are connected together as in FIG. 1. Each body member 16 and 18 includes a foot retaining segment 32 and 34, respectively. Each segment 32 and 34 may be at least partially arcuate to conform about the foot or footwear of a user (discussed herein after in greater detail).

Each of the foot retaining segments 32 and 34 may also include means for attaching the device 10 about the foot of a user. To this end, in the example, strap apertures 36 are provided on each of the body members 16 and 18. This arrangement is adapted to receive a strap 38, shown in position in FIG. 1. This is an option; the body members 16 and 18 and in particular the foot retaining segments 32 and 34 may be sufficiently resilient to compressively engage the foot or footwear of a user and further, may simply employ the laces (not shown) of the footwear to act as an attachment. Any suitable further example for attaching the device to footwear is contemplated.

In the example, the body members 16 and 18 each include a downwardly and outwardly extending stabilizing segment 40 and 42, respectively. The latter are coextensive with the former. The stabilizing segment is downwardly and outwardly extending relative to the foot retaining segments 32. In this manner, each of the segments is in an angularly inclined plane relative to the plane of the foot retaining segments 32 and 34. In particular, each of the segments includes an intermediate portion 44 and 46, respectively which segment is exposed in the angularly inclined plane noted above. This feature provides not only a spaced relationship between the foot retaining portion 12, but also imparts strength to the stabilizing portions 40 and 42.

Each stabilizing segment 40 and 46 has a terminal end portion 48 and 50, respectively which portions have an arcuate configuration where the arc is directed upwardly towards the foot retaining portion 12. In the example shown, the foot retaining portions 48 and 50 are convex, however, it will be understood that the portions 48 and 50 need not be convex, but rather may simply provide a slight upward inclination to reduce drag or friction. In furtherance of the reduction of drag and friction, optionally, each terminal portion 48 and 50 may include a ball bearing (shown in dotted line) 52 and 54, respectively. The ball bearing can be simply caged within the terminal edge and portion to provide a user with the maximum degree of freedom. It will be understood that although a ball bearing arrangement is showing a dotted line that any and ancillary device which provides a similar function could be employed.

Figure 2:
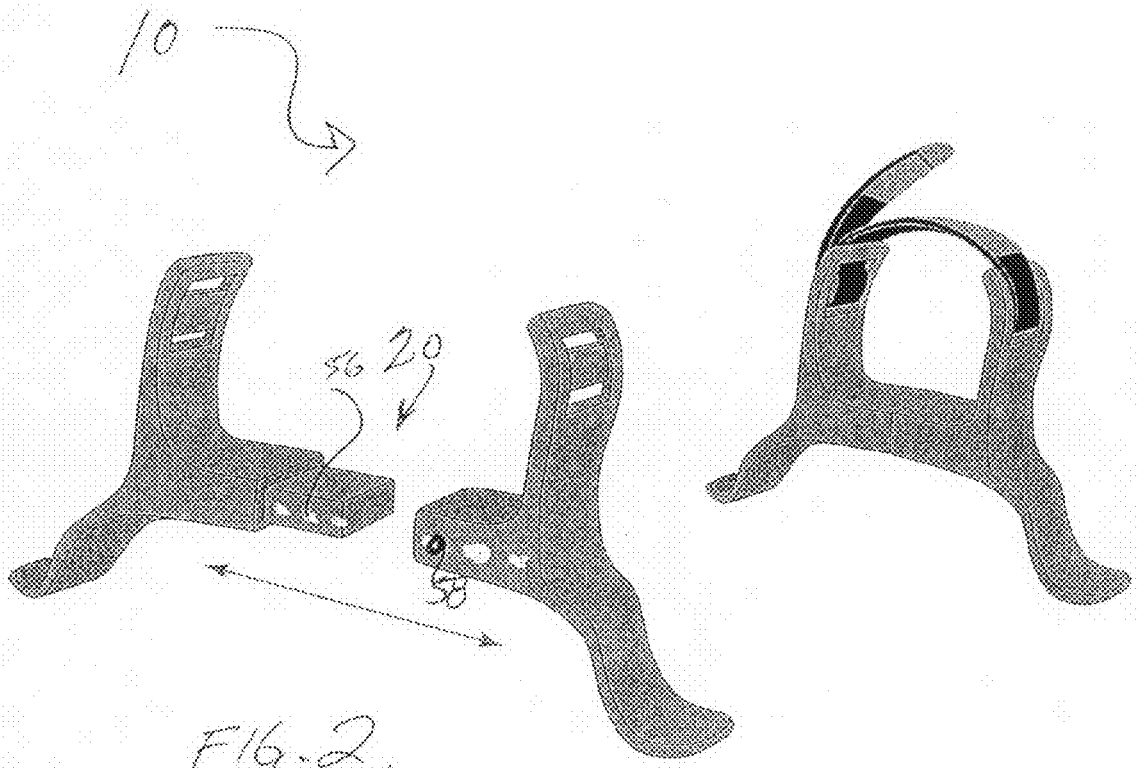
FIG. 2 is an exploded view to similar FIG. 1A illustrating a second embodiment of the releaseable lock means.

Referring now to FIG. 2, shown is a further embodiment of the device 10 where the releasable engageable lock means 20 as shown as a ball 56 and aperture for 58 for receiving the ball of 56. The ball may be of the type that is spring loaded and releasably settable aperture 58.

Figure 3:
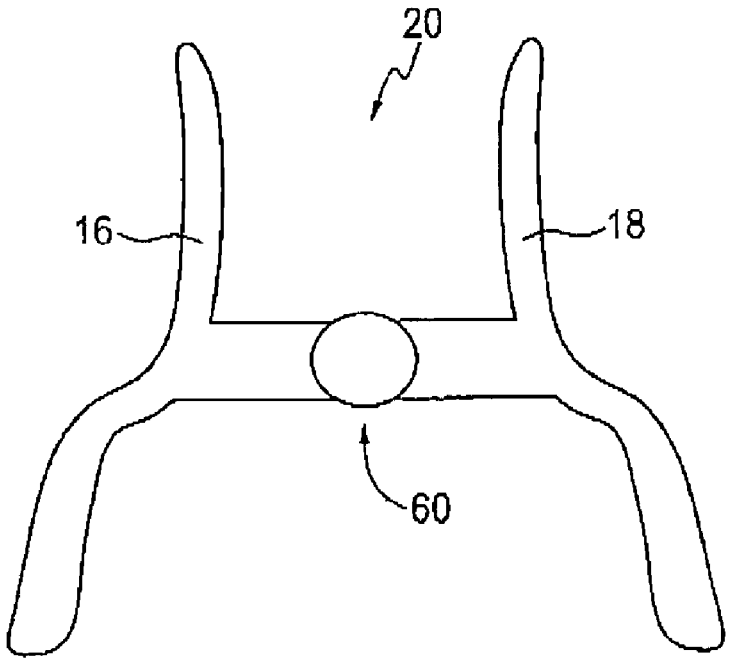
FIG. 3 is a front view of a further embodiment of the present invention illustrating another variation of the releasable lock means.

FIG. 3 illustrates yet a further variation on the lock means 20. In this arrangement, the lock means 20 comprises a hinge 60, which hinge 60 may be of the ratchet variety for providing pivotal locking motion between body members 16 and 18.

Figure 4:
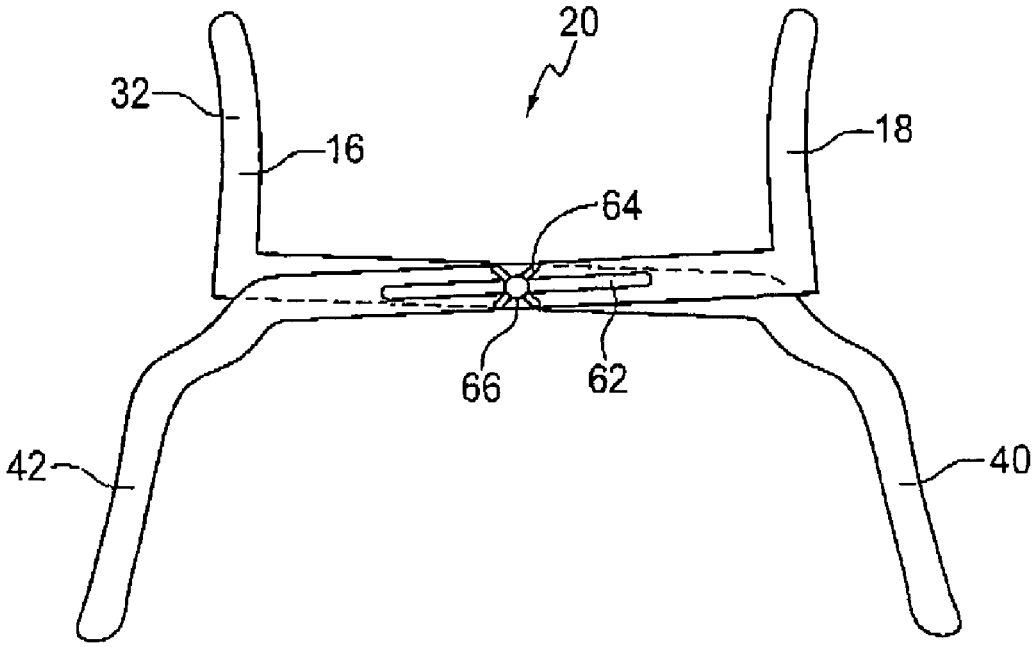
FIG. 4 is a front view of another variation of the present invention.

FIG. 4 illustrates yet another variation to the arrangement shown initially in FIGS. 1 and 1A. In the embodiment shown in FIG. 4, the lock means 20 comprises a raceway 62, which raceway is common to both body members 16 and 18 and which are interconnected by a typical wing nut 64 and screw 66.

It is to be noted in FIG. 4 that instead of body member 16 having the stabilizing segment 40 coextensive with foot retaining segment 32, the same is laterally displaced in a spaced apart parallel plane. This is achieved by extending the base portion 28 and 30 to effectively extend entirely across the foot retaining area 12.

Figure 5:
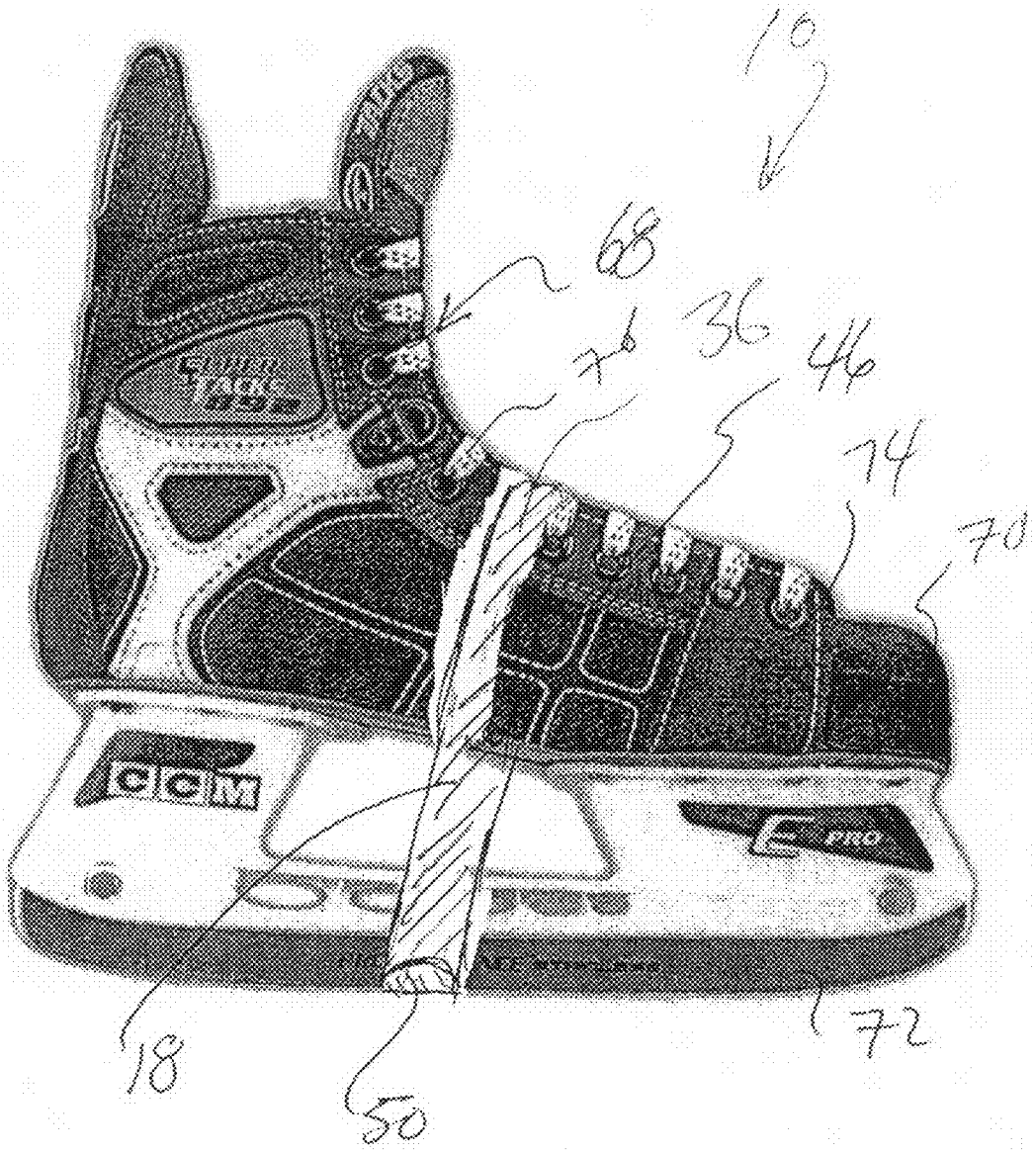
FIG. 5 is a side view of the device according to one embodiment of the invention in situ about an ice-skate.

Turning to FIG. 5, shown is an illustration of the device 10 as positioned about a skate 68. The skate 68 has a sole portion 70 and a blade 72. In the embodiment shown, the device 10 is secured about the boot portion 74 of skate 68 using the laces 76 through the attachment members 36 discussed herein previously in FIGS. 1 and 1A.

Figure 6:
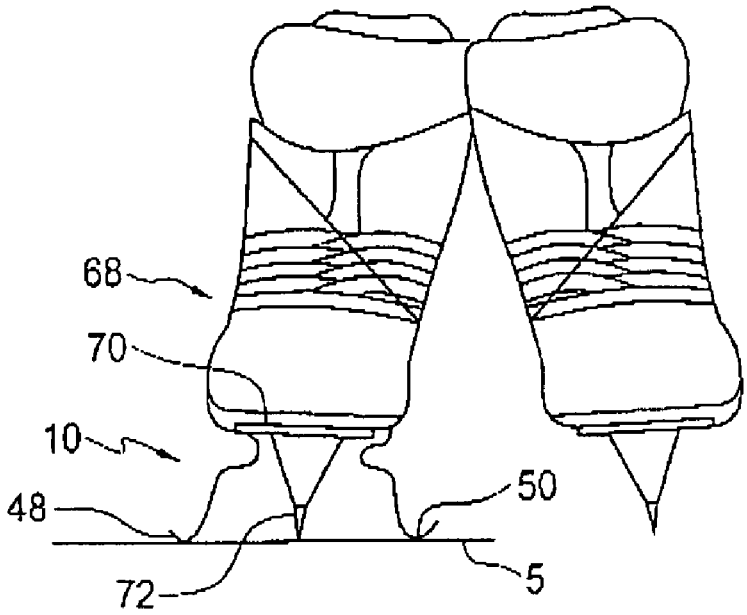
FIG. 6 is an end view of the device as positioned about an ice skate.

Turning to FIG. 6, shown is the disposition of the device 10 on the skate 68. As is illustrated, the terminal end portions 48 and 50 contact the surface 5 to provide lateral stability to the skate or skate boot of the user. The device 10, once positioned as shown in FIG. 6 provides a significant lateral stability to retain the foot of the user in a proper attitude and therefore prevent any unbalance during use of the skate, shown in FIGS. 5-6 as an ice skate.

It has been found that the material of which the device 10 may be constructed can be any suitable material which provides at least the limited flexibility. To this end, suitable examples are plastic, metal, composites and combinations thereof. In terms of the plastics, suitable examples include polycarbonate, polyethylene, polystyrene, nylon, polyvinyl floride, polyethylene terephthalate (PET). Other suitable examples will be readily apparent to those skilled in the art.

Figure 7:
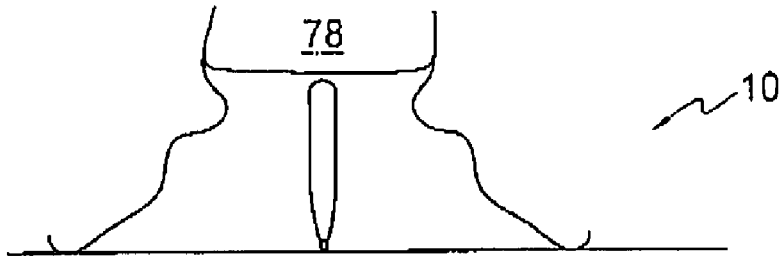
FIG. 7 is a view similar to FIG. 6 with the device positioned about an in-line skate.

In respect of FIG. 7, shown is the device 10 as positioned about a roller skate, shown in the example as an in-line roller skate and denoted by numeral 78.

Figure 8:
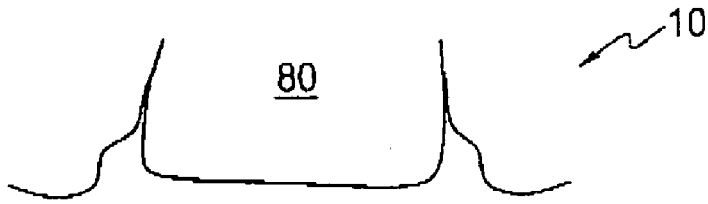
FIG. 8 is a view similar to FIGS. 6 and 7 with the device positioned about a typical walking shoe.

In respect of FIG. 8, shown is yet another example of the device 10 as positioned about a walking shoe, globally denoted by numeral 80.

Figure 9:
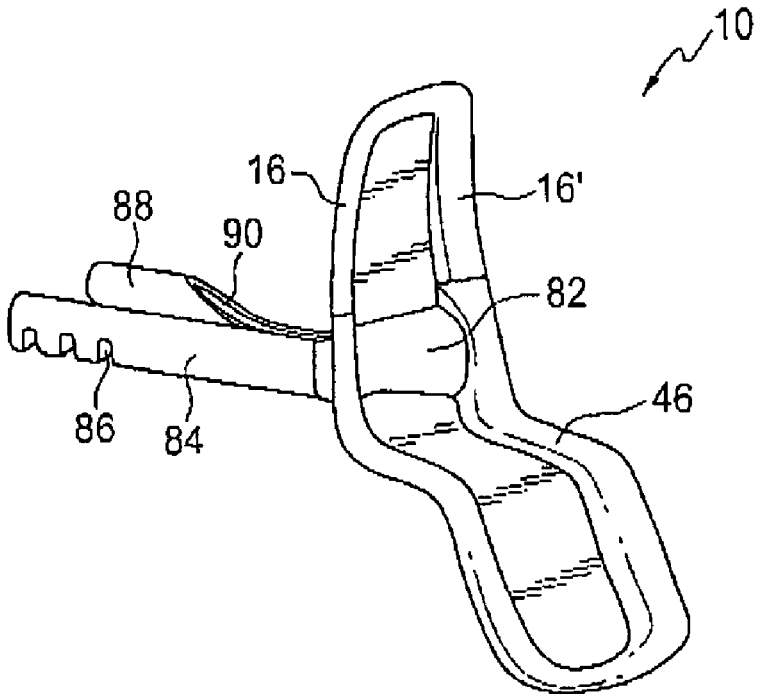
FIG. 9 is a perspective view of one support member of a further embodiment of the present invention.

Referring now to FIG. 9, shown is a perspective view of a further embodiment of the device 10. In this embodiment, the device 10 includes a pair of body members 16, 16' and 18, 18' (FIG. 10) which members are interconnected by a support bridge member 82 extending between members 16 and 16'. It will be understood that body members 18 and 18' are also interconnected by such a bridge, however, this is best shown in FIG. 11.

Figure 10:
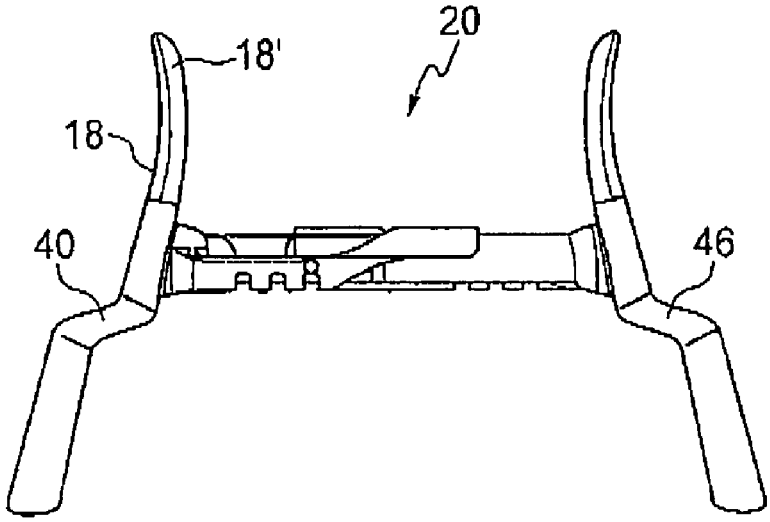
FIG. 10 is a side view of the support member embodiment of FIG. 9 as connected with a second identical support member and where combined in a working system provide an equal and opposite pair of two interconnected support members.

FIG. 10 illustrates a side view of the embodiment of FIG. 9 illustrating the releasable lock means 20 according to the embodiment in FIG. 9 et. seq. In this embodiment, the lock means 20 comprises a slotted arm 84, shown best in FIG. 11, having spaced apart slots 86 and spaced laterally therefrom a second arm 88 having a groove 90 therein.

Figure 11:
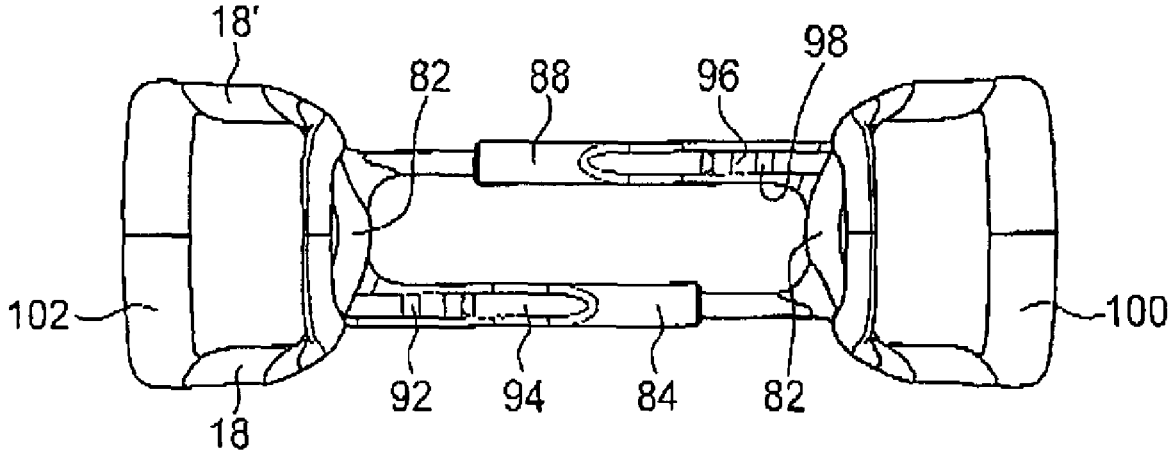
FIG. 11 is a top view of the device shown in FIG. 10.
Figure 12:
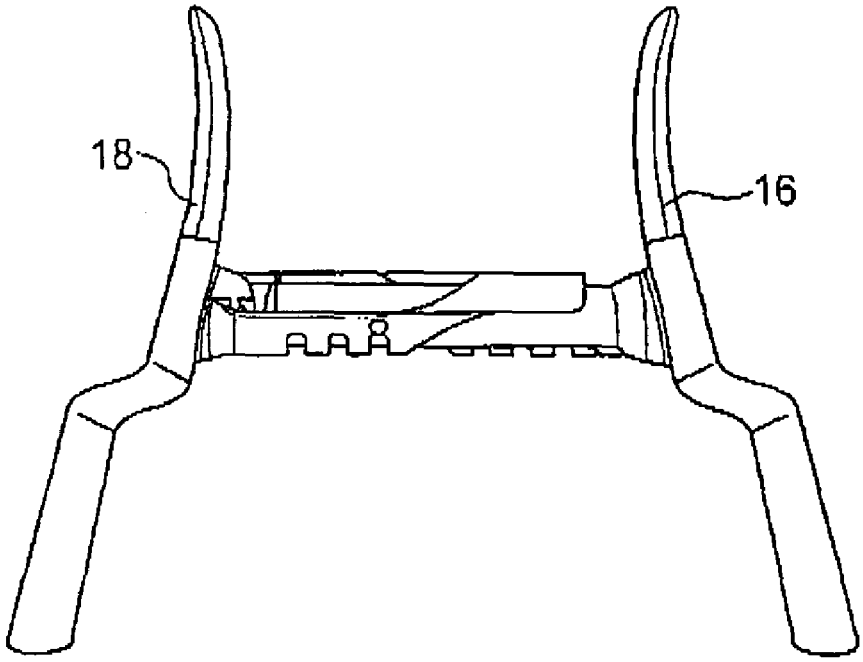
FIG. 12 is a front elevation view of the device in FIG. 11.

Referring now to FIGS. 10 and 11, shown is the arrangement of the releasable locking means 20. As discussed with respect to FIG. 9, body members 16 and 16' include slotted arm 84 and second arm 88 with groove 90. In a similar manner, the body members 18 and 18' include similar structures for releasable cooperative engagement between corresponding parts. To this end, body member 18 includes arm 92 having grove 94 therein, body member 18' includes slotted arm 96 having slots 98 therein. This is best shown in FIG. 12.

As will be appreciated, in the embodiment shown in FIGS. 9 through 12, the terminal end portions in this embodiment comprise terminal end sections 100 and 102. This is due to the fact that the body portions 16 and 16' as well as 18 and 18' are connected to provide continuous loops. As an option, the area within the loops may be filled in as shown with the diagonal lines in FIG. 9. This would allow an area for indicia.

In terms of the additional details for purposes of the use of the device, although only one device is shown as positioned about the foot wear shown in FIGS. 6 through 8, it will be appreciated that a plurality of such devices may be positioned about each foot or article of foot wear. As an example, depending on skill level, a user may require initially at least two such devices positioned about the foot wear and as experience and confidence develops, this may be reduced to a single device. Other variations will be appreciated by those skilled in the art.

Figure 14:
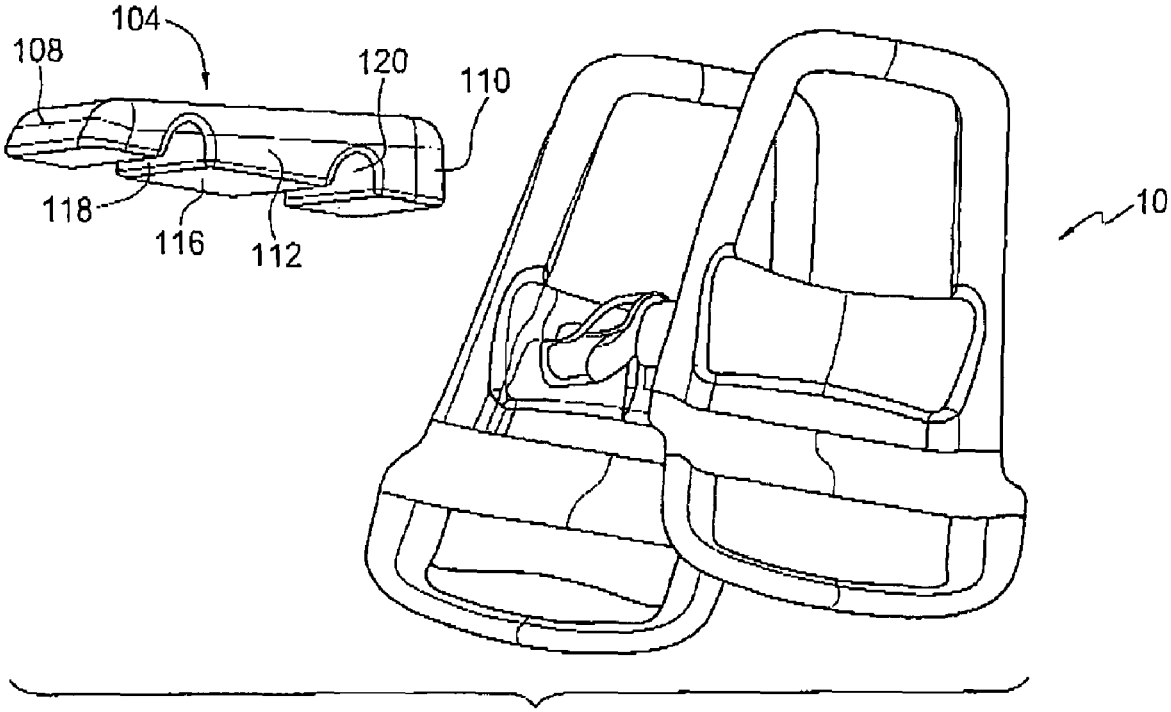
FIG. 14 is a further view of FIG. 13 with the insert in isolation.

FIG. 14, shown is a further embodiment of the present invention where the arrangement 10 includes a wedge member, globally denoted by numeral 104. The wedge member 104, more easily seen in FIG. 14, generally has a parallelogram shape, i.e., either a square or a rectangular shape when viewed in plan view and a wedge, or triangular shape when viewed from the side. The wedge provides a top surface 106, a front surface 108, and a rear surface 110 and sides 112 and 114. The underside or bottom 116 includes spaced-apart grooves 118 and 120. The height of the front wall 108 relative to the rear wall can vary from a ratio of heights of 1:1, to 1:3. This is merely an example, the wedge can be modified in any fashion. Each of the grooves 118 and 120, when wedge 104 is in position, engaged the releasable lock means 20, and more particularly, the cooperating members 84, 88 and 92, and 96. In this manner, a further lock is provided for the cooperating means and also, this conveniently provides a tension and location for the device 10 when it is positioned about the footwear.

Figure 13:
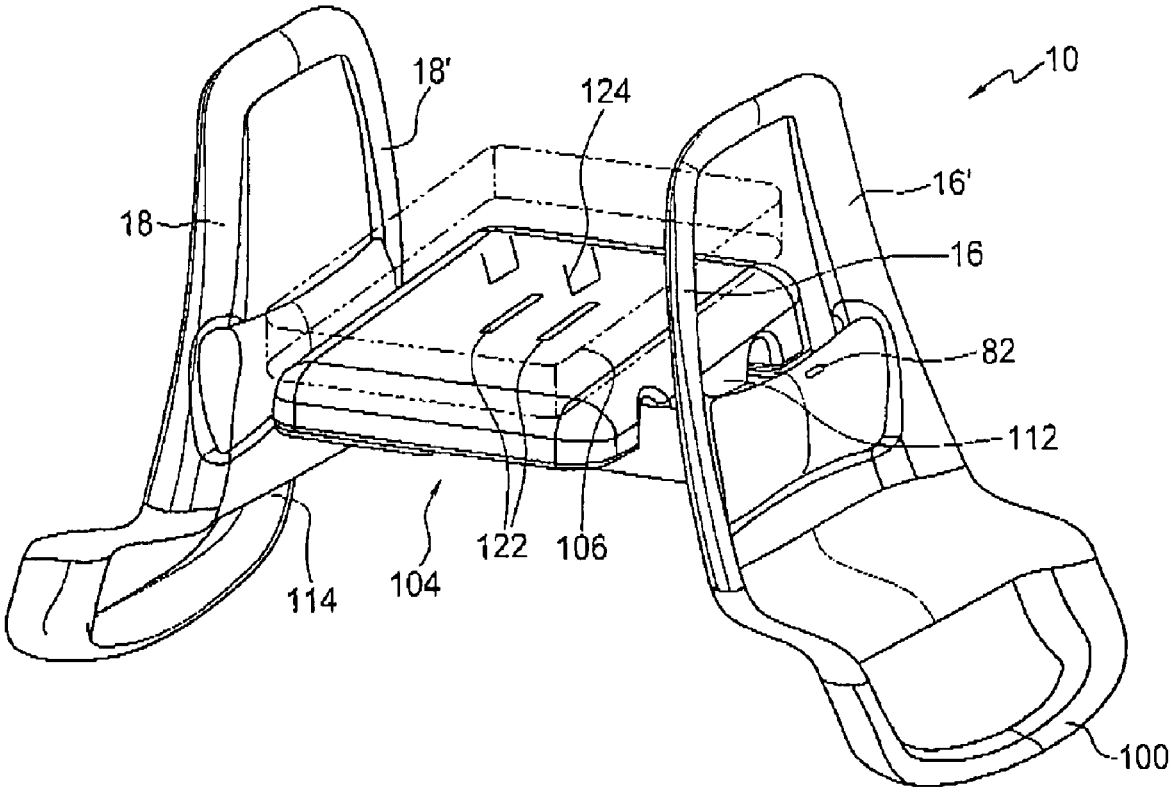
FIG. 13 is a perspective view of a further embodiment of the present invention.

From previous specification herein, the device is, in the case of footwear and particularly a skate, positioned on the underside of the skate. In this manner, the wedge not only locates the position of the device relative to the ground, but also ensures proper tensioning and spacing between the sole of the footwear (not shown in FIGS. 13 and 14) and the device 10. In situations where the greater degree of tension is required, the arrangement may include two such wedges 104. In this manner, top wall 106 of number 104 may include apertures 122, which apertures receive a further foam wedge 104 in overlying relation therewith. The overlying wedge 104 is shown in dotted line in FIG. 13 and the second overlying wedge 104 could include connecting means 124 to cooperate with apertures 122. The wedge, when in position and by virtue of its shape, alters the position of the device relative to the footwear, i.e., the angular disposition of the device.

It is to be noted that the material of which the foam wedge could be made is any suitable polymer or rubber compound which not only provides a durability, but also a certain degree of resiliency to conform to irregular shapes, such as that which would be experienced with the sole of a skate. Suitable materials for the foam wedge could also further include open or closed cell foams, Sorbathane™, styrofoam, EPDM foam, inter alia.

It would be appreciated by those skilled in the art that this arrangement is one possible embodiment, subject to variation without deviation and function.

The embodiments of the invention described above are intended to be exemplary only. The scope of the invention is therefore intended to be limited solely by the scope of the appended claims.

We claim:

1. A stabilizing device for use on a skate, the skate having a boot with: left and right sides; an upper portion and a bottom sole, the device comprising:

a left support member and a right support member being identical to the left support member;

each support member having a boot side retaining segment for abutment against one of the left and the right sides of the boot; and a stabilizing segment having an intermediate portion extending outwardly and downwardly from each boot side retaining segment, each intermediate portion having a terminal end portion extending downwardly therefrom and adapted for contact with a surface on which lateral stability is required, each terminal end portion being disposed laterally outwardly of the boot side retaining segment;

a base portion extending laterally from each intermediate portion defining a boot sole receiving area, each base portion including manually releasably engageable lock means for releasable locking engagement of the left support member with the right support member manually without requiring the use of any tool.

2. The device as set forth in claim 1, further including a sole spacer member for releasable engagement with said sole receiving area for spacing said sole receiving area from the sole.

3. The device as set forth in claim 1, wherein the base portions of said left support member and right support member are pivotally connected.

4. The device as set forth in claim 1, wherein the base portions of said left support member and right support member are detachable.

5. The device as set forth in claim 1, wherein each said terminal end is arcuate in a vertical plane.

6. The device as set forth in claim 5, wherein each said terminal end is convex.

7. The device as set forth in claim 1, wherein each said left support member and right support member comprise a flexible material.

8. The device as set forth in claim 7, wherein said flexible material is selected from the group of consisting plastic, metal, composites and combinations thereof.

9. The device as set forth in claim 1, wherein at least one of the left and right support members has a boot retaining segment including attachment means for attaching said device about the boot.

10. The device as set forth in claim 9, wherein said attachment means comprises a strap.

11. The device as set forth in claim 9, wherein said attachment means includes strap receiving apertures in each boot retaining segment.

12. The device as set forth in claim 1, wherein said releasably engageable lock means is selected from the group consisting of: a compression lock; a pivoting lock; a slidable lock; a rotatable lock; a and combinations thereof.

13. The device according to claim 1 wherein each base portion for each of the left and right support members comprises:

a first arm having a proximal end extending laterally from the intermediate portion and a distal end having a first engagement end; and a second arm having a proximal end extending laterally from the intermediate portion and a distal end having a second engagement end matching the first engagement end.

14. The device according to claim 13 wherein:

the first engagement end has an exterior surface profile; and the second engagement end includes a groove matching the exterior surface profile of the first engagement end and slidably engaging the first engagement end.

15. The device according to claim 14 wherein:

the first engagement end has a plurality of slots; and the second engagement end includes a locking pin matching the slots of the first engagement end whereby a lateral dimension of the boot sole receiving area is manually adjustable.

16. The device according to claim 13 wherein the sole spacer member includes two lateral grooves in an underside surface matching an upper surface of the first and second arms when engaged together to define the boot sole receiving area.

17. The device according to claim 2 wherein the sole spacer member has an upper surface including a receiving aperture for receiving a connector of an auxiliary spacer member.

* * * * *